United States Patent [19]

Lockard

[11] 3,965,319

[45] June 22, 1976

[54] LIGHTED MOMENTARY SWITCH ARRAY

[75] Inventor: Joseph Larue Lockard, Harrisburg, Pa.

[73] Assignee: AMP Incorporated, Harrisburg, Pa.

[22] Filed: Nov. 7, 1974

[21] Appl. No.: 521,725

[52] U.S. Cl. ..... 200/310; 200/6 BB; 200/6 B; 200/153 LB; 324/51

[51] Int. Cl.[2] ..... H01H 9/00

[58] Field of Search ..... 200/308–340, 200/153 LB, 153 R, 6 B, 6 BA, 6 BB, 6 C; 324/51

[56] References Cited

UNITED STATES PATENTS 2,644,062 6/1953 Williams ..... 200/6 BB X 3,878,344 4/1975 Lockard ..... 200/318

OTHER PUBLICATIONS

Advertisement for AMP Incorporated, Design News, Apr., 1973, 4 pages.

*Primary Examiner*—Robert K. Schaefer
*Assistant Examiner*—M. Ginsburg
*Attorney, Agent, or Firm*—Gerald K. Kita

[57] ABSTRACT

A manually actuated momentary switch completes an electrical circuit for lighting a low voltage indicator light advantageously used for testing circuit continuity. The switch and indicator light are in combination within a miniature size housing having depending electrical terminals for pluggable connection on a printed circuit board.

2 Claims, 5 Drawing Figures

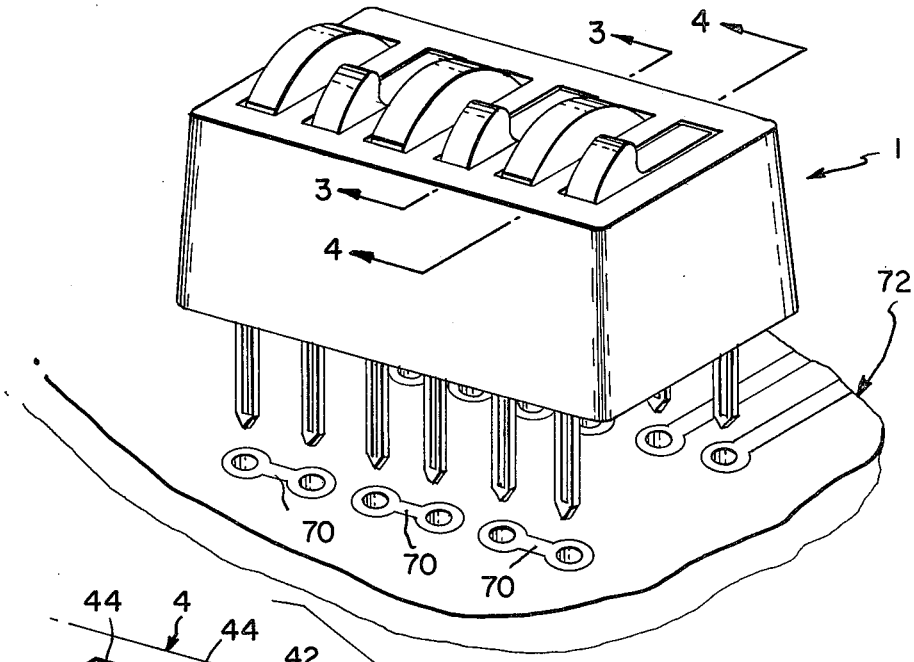
FIG. 1
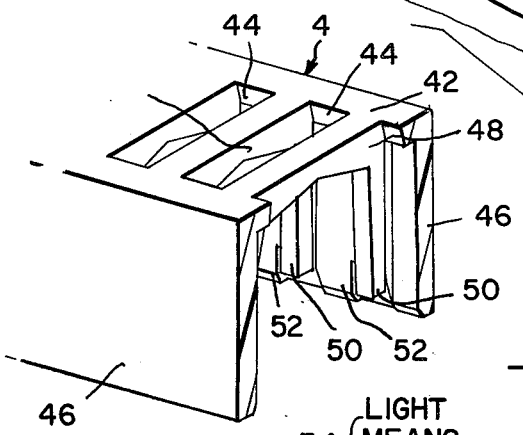
FIG. 2
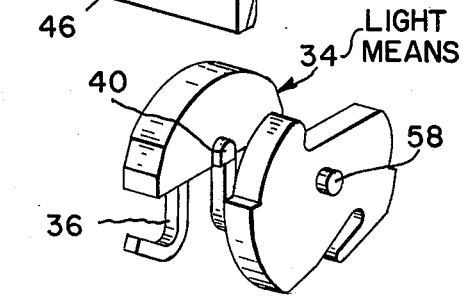
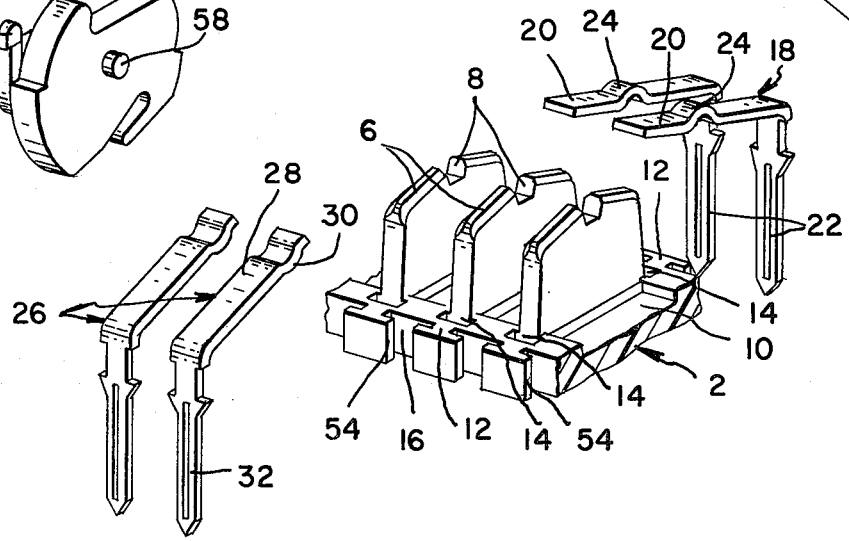

LIGHTED MOMENTARY SWITCH ARRAY

BACKGROUND OF THE PRIOR ART

Circuitry fabricated from solid state circuit components are arranged on a printed circuit board and are electrically interconnected by circuit paths of the printed circuit board. There has been a long existing need for a continuity testing device which is of miniature size suitable for mounting directly on the printed circuit board together with the circuit element or component. Such a testing device should include an indicator which is activated by a voltage compatible with the logic level voltages operating the circuit components.

BRIEF DESCRIPTION OF THE PREFERRED EMBODIMENTS

According to the invention, the combination of a manually actuated momentary switch and a low voltage or indicator light is combined within a housing of miniature size, with electrical leads depending from the housing in parallel rows in the familiar dual-in-line package configuration standardized according to solid state circuit components. A suitable indicator light is in the form of a light emitting diode LED which requires low level voltages for activation for compatibility with solid state logic level voltages. The depending leads advantageously interconnect the LED with the circuitry of the printed circuit board. Other leads provide initially spaced switch contacts within the switch housing. A manually actuated cam is displaceably mounted for biasing the switch contacts into engagement for completing an electrical circuit therebetween. The switch contacts when connected to the circuitry of the printed circuit board in a proper fashion will activate the LED as an indication that the circuitry is continuous through the switch, through the circuit components and through the LED which is lighted.

It is therefore an object of the present invention to provide in combination a momentary manually actuated switch and a lighted indicator in a housing which is of miniature size and adapted for pluggable electrical connection to the circuitry of a printed circuit board.

Another object is to provide a circuit continuity test device which is of miniature size and mountable on a printed circuit board containing the circuit to be tested, wherein the test device is in the form of a manually actuated switch and indicator light having depending leads in a dual-in-line package configuration.

Other objects and many attendant advantages of the present invention will become apparent upon perusal of the following detailed description taken in conjunction with the drawings.

BRIEF DESCRIPTION OF THE DRAWINGS

FIG. 1 is an enlarged fragmentary perspective of an array of lighted switches according to the present invention.

FIG. 2 is an enlarged fragmentary perspective with parts in exploded configuration illustrating the details of the switch illustrated in FIG. 1.

DETAILED DESCRIPTION OF THE PREFERRED EMBODIMENTS

Figure 3:
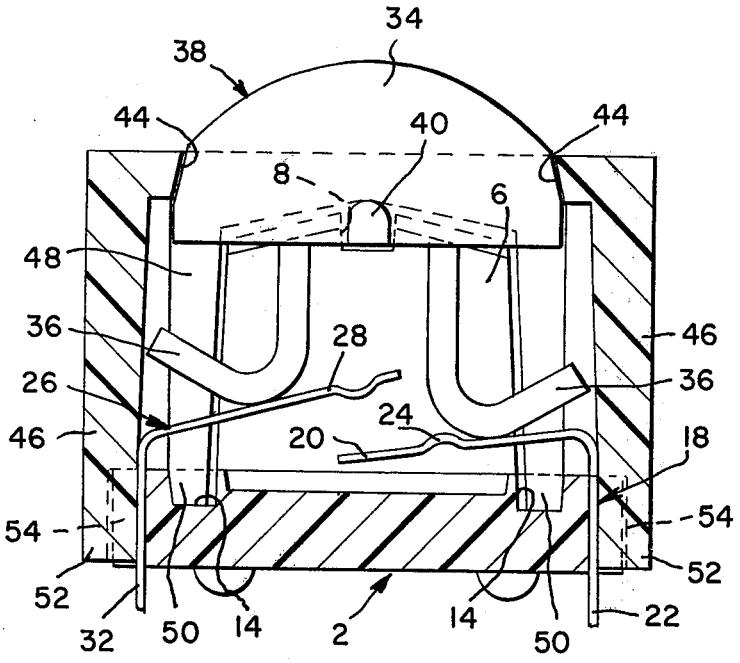
FIG. 3 is an enlarged section taken along the line 3—3 of FIG. 1.

With more particular reference to the drawings there is shown generally at 1 in FIG. 1 a preferred embodiment of an array of switches and indicator lights according to the present invention. As shown in FIG. 2, the array includes a housing having a base portion 2 and a cover portion 4. More specifically the base portion 2 includes a plurality of spaced uprights or partitions 6 having a recessed notched portion 8 centrally at the top of each partition. The notches 8 are aligned and are for a purpose to be described hereinafter. The partitions 6 are advantageously molded integrally with the bottom wall 10 together with a pair of integral enlarged rails 12 laterally interconnected with each of the partitions 6. Adjacent each of the partitions 6 each rail 12 is provided with generally rectangular vertical recesses 14, and with vertically slotted portions 16 in alignment with the spaces between adjacent partitions 6. A first row of contacts 18 are provided by strips of metal which are stamped and formed into elongated configurations. Each contact 18 includes a first end portion 20 received between the corresponding space between adjacent partitions 6. The second end portion 22 of each contact 18 projects through a corresponding slotted portion 16 of a rail 12 thereby connecting the contact 18 by a sleeve arrangement. Additionally the end portion 22 of each contact projects in depending relationship outwardly from the base portion 10 in order to provide an electrical terminal for pluggable connection externally of the switch 1. An arcuate portion 24 is provided on each end portion 20 adjacent the tips thereof. A similar row of contacts 26 are sleeved along the other rail 12. More particularly each contact 26 includes a first end portion 28 having an inverted arcuate bent portion 30. A second end portion 32 of each contact 26 is received in a corresponding vertically slotted portion 16 of the corresponding rail 12 to connect the contacts. As shown the rows of contacts 26 project into the space between corresponding partitions 6 and initially project in spaced overlapped relationship with respect to the end portions 20 of the contacts 18. This is shown in FIGS. 3 and 4.

As shown in FIGS. 2 and 3, a first pair of overlapped contacts 18 and 26 receive thereover a light-emitting diode assembly 34. Such an assembly typically includes a light-emitting diode (not shown) having a fragile pair of electrical leads which are bonded to a pair of depending relatively stiff conducting leads 36. The diode and its leads as well as portions of the leads 36 are embedded within a light transparent encapsulant 38 which is molded to or machined to a generally convex shape providing a diffuser for the light emitting from the LED while at the same time protecting the LED and leads thereof from damage. The encapsulant is also provided with a pair of outwardly projecting integral lugs 40 such that, upon location of the encapsulant between a pair of partitions, the lugs 40 will register within corresponding notches 8 of the partition to locate and mount the encapsulant in desired location as shown in FIG. 3. The depending stiff leads 36 compressibly engage against corresponding contact end portions 20 and 28 to provide an electrical engagement therewith and further to provide a continuous electrical circuit from one contact 18 through the LED and its leads 36 and through the remaining contact 26. The cover 4 includes a top surface 42 provided with a plurality of elongated and parallel slots 44. As shown in FIG. 3, the slots have arcuate end walls which overlie the encapsulant 38 when the cover is installed over the base 2. Integral side walls 46 of the cover are interconnected by integral inverted generally U-shaped partitions 48 having projecting foot portions 50 internally of the sidewalls 46. With the cover assembled to the base 2 the foot portions 50 are pluggably received into corresponding apertures 14 of the rail 12. In addition, between the partitions 50 are provided integral depending tongues or flanges 52 interiorly of the sidewalls 46. The flanges 52 overlie the slotted portion 16 of the rails 12 by registration within relieved portions 54 provided in the outer lateral surfaces of the rails 12, which relieved portions 52 communicate with corresponding slotted portions 16. Thus as shown in FIG. 3, the inverted U-shaped partitions 48 overlie corresponding partitions 6 and the flanges 52 impinge against the contact portions 22 and 32 when the cover is assembled to the base. The contacts therefore are gripped between the corresponding portions of the cover and the base and are constrained thereby. Further the contacts are constrained from movement by being pluggably received with the slotted portions 16 prior to assembly of the cover to the base.

Figure 4:
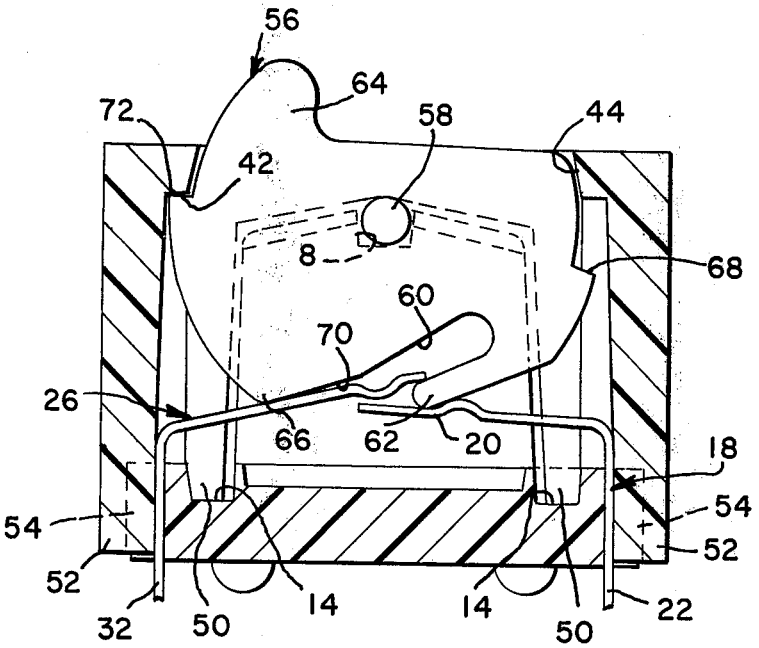
FIG. 4 is an enlarged section taken along the line 4—4 of FIG. 1.
Figure 5:
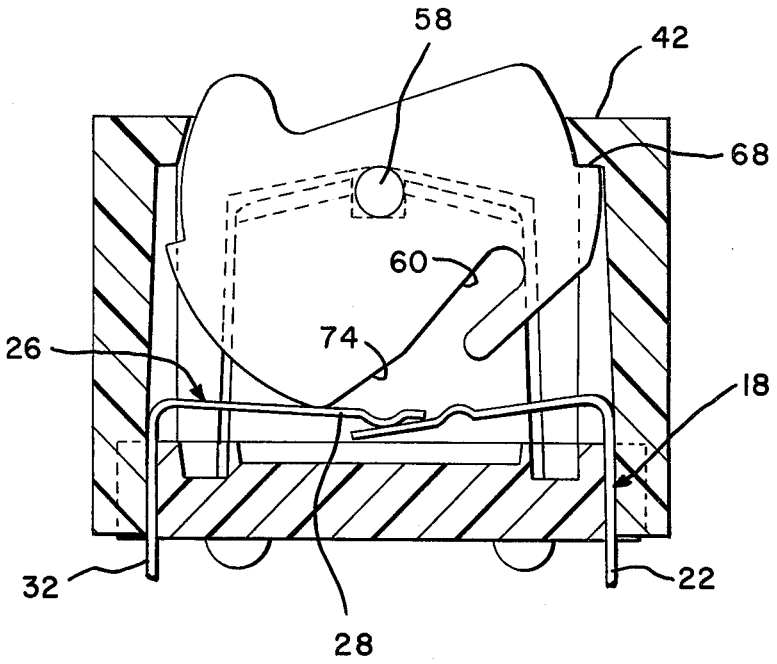
FIG. 5 is an enlarged section similar to that illustrated in FIG. 4 showing an alternative position of the component parts of the switch.

As shown in FIG. 4, each LED assembly of the present invention is associated with a manually actuated switch a preferred embodiment of which is shown in FIG. 4. Each switch includes a pair of contacts 18 and 26 assembled initially in spaced and overlapped relationship within corresponding slotted portions 16 of the rails. The contacts are assembled in a space between a corresponding pair of partitions 6 and are further overlied by a cam generally shown at 56 which includes a pair of projecting cylindrical axles 58 which project from opposite sides of the cam. The axles are received within corresponding notches 8 of the partitions 6 and provide solid axles over which the cam is displaced by pivotal or rotational action. The outer periphery of the cam includes a relatively deeply indented recess portion 60 initially receiving the diagonally projecting end portion 28 of the corresponding contact 26. Adjacent to the recess portion 60 is provided a first relatively narrow projecting portion or finger 62 which initially is interposed between the end portion 28 and 20 of the corresponding contacts 26 and 18 ensuring separation thereof. Further the projecting finger 62 is engaged with each of the end portions 28 and 20 to further ensure their separation and to prevent their engagement by chattering when the switch is subjected to vibration. In its initial position shown in FIG. 4, the cam includes an integral lever portion 64 projecting through a corresponding slot 44, which lever is adapted for manual engagement by an operator of the switch. As shown in FIG. 5 the cam is displaced to a second position upon the application of pressure to the lever portion 64 displacing the cam by rotation about its pivots or axles 58 and displacing the first projecting portion or finger 62 from its initial position between the contact 18 and 26. The cam 56 includes a second projecting portion 66 adjacent to the recessed portion 60 which is displaced into forcible engagement against the corresponding contact 26 overcoming the resilient spring forces thereof and deflecting it into engagement with the corresponding contact 18. Further displacement of the cam forces the projecting portion 16 to further deflect both the contact end portions 28 and 20 while engaged so that a sliding or wiping action is produced between the contact end portions which improves the electrical engagement therebetween. Counterclockwise rotation of the cam continues until an integral projecting shoulder or stop 68 engages against the inverted surface of the top wall 42 of the cover. With the contacts 26 and 18 into mutual engagement, a circuit path is completed therebetween. The depending portions 32 and 22 of the contacts advantageously may be interconnected by circuitry shown for example at 70 in FIG. 1 on an exemplary circuit board 72 to which the switch 1 may be pluggably mounted. The resiliently deflected contact portion 28 will tend to return to its original position as shown in FIG. 4 by return resilient deflection. Such deflection action will force the cam 56 to return to its original position as shown in FIG. 4 since the contact portion 28 will tend to pivot the cam about its pivots or axles 58. The contact portion 28 will also tend to impinge against the relieved surface 74 of the recessed portion 60. Thus when the contacts and cam return to their original positions as shown in FIG. 4, another projecting shoulder or stop portion 72 on the cam adjacent to the lever portion 64 will be pivoted or rotated into engagement against the inverted surface of the top wall 42 of the cover. The cam is held motionless between the cover and the contact portion 28 to maintain the cam and contacts in their positions as shown in the figure. Accordingly the cam 56 is manually displaceable to provide a momentary switch which has a single stable position in its deactivated or "off" mode of operation. The contacts which are mutually engaged by activation of the corresponding cam will momentarily complete a circuit through a corresponding LED causing it to provide a visual indication that a circuit path is completed through the switch, the corresponding LED and the circuitry interconnected with the LED on the circuit board 72.

Although a preferred embodiment of the present invention has been described in detail other preferred embodiments of the present invention are intended to be covered by the spirit and scope of the apended claims.

What is claimed is:

1. An indicator light and switch in combination, comprising:

a housing, a pair of first contacts in said housing, light means having a pair of electrical leads engaged respectively on said first pair of contacts, said first pair of contacts protruding from said housing to form electrical terminals for pluggable connection externally of said housing, a second pair of contacts in said housing initially in spaced overlapping relationship, a cam displaceably mounted in said housing and having a first portion initially in a single stable position interposed between said second pair of contacts, a second portion on said cam being displaceable upon displacement of said cam to deflect one of said second pair of contacts into engagement with the other of said second pair of contacts to complete an electrical circuit therebetween, said first portion of said cam being displaceable away from said position initially interposed between said second pair of contacts to permit mutual engagement of said contacts, and said second pair of contacts protruding from said housing to provide electrical terminals for pluggable connection externally of said housing.

2. A momentary switch, comprising a pair of overlapping contacts initially in spaced relationship, a cam having a first integral projecting portion initially in a single stable position interposed between said overlapping contacts and being movable upon displacement of said cam out of said position, said cam having a second integral projecting portion being displaceable upon displacement of said cam of forcibly deflect one of said contacts into engagement with the other of said contacts to complete an electrical circuit path therebetween and said cam being urged to return to said stable position by a return deflection of said one of said contacts.

* * * * *